US008899875B1

(12) United States Patent
Bramble et al.

(10) Patent No.: US 8,899,875 B1
(45) Date of Patent: Dec. 2, 2014

(54) APPARATUS, SYSTEM, AND METHOD FOR DIVERTING WATER AWAY FROM A BUILDING FOUNDATION

(75) Inventors: Curtis Bramble, Kansas City, MO (US); Otto W. Fleck, Kansas City, MO (US); Lowell Hickman, Riverside, MO (US)

(73) Assignee: Dry Basement, Inc., Kansas City, MO (US)

( * ) Notice: Subject to any disclaimer, the term of this patent is extended or adjusted under 35 U.S.C. 154(b) by 390 days.

(21) Appl. No.: 13/399,408

(22) Filed: Feb. 17, 2012

Related U.S. Application Data

(60) Provisional application No. 61/443,961, filed on Feb. 17, 2011.

(51) Int. Cl.
*E02B 9/04* (2006.01)

(52) U.S. Cl.
USPC ..... 405/119; 52/16

(58) Field of Classification Search
USPC ..... 405/119; 404/2; 52/16, 169.5, 97; 137/615, 357; D25/112
See application file for complete search history.

(56) References Cited

U.S. PATENT DOCUMENTS

| | | | | | |
|---|---|---|---|---|---|
| 3,316,928 | A | * | 5/1967 | Weakley | 137/119.06 |
| 3,636,830 | A | * | 1/1972 | Watts | 404/2 |
| 4,135,540 | A | * | 1/1979 | Felsen | 137/78.5 |
| 5,358,006 | A | * | 10/1994 | Sweers | 137/615 |
| 5,358,007 | A | * | 10/1994 | Carlberg | 137/615 |
| 5,441,364 | A | * | 8/1995 | Dressler | 405/119 |
| 5,658,092 | A | * | 8/1997 | Sweers | 405/118 |

* cited by examiner

*Primary Examiner* — Sunil Singh
(74) *Attorney, Agent, or Firm* — Erise IP, P.A.

(57) ABSTRACT

An apparatus, system, and method for diverting water away from a building's foundation using improved splash blocks. A starting splash block is positioned proximate a building's foundation and under the building's water discharge line. A running splash block is positioned end-to-end with the starting splash block. A coupling assembly couples the front end of the starting splash block to the rear end of the at least one running splash block in the end-to-end configuration. The coupling assembly and configuration of the starting and running splash blocks allows for the running splash block to pivot with respect to the immediately preceding splash block in line. Upwardly extending projections are also provided on a bottom of the splash blocks to facilitate a reduction in velocity of the water transported through the splash blocks.

12 Claims, 10 Drawing Sheets

APPARATUS, SYSTEM, AND METHOD FOR DIVERTING WATER AWAY FROM A BUILDING FOUNDATION

RELATED APPLICATION

This patent application claims priority benefit, with regard to all common subject matter, of earlier-filed U.S. Provisional Patent Application No. 61/443,961, filed Feb. 17, 2011, and entitled "APPARATUS, SYSTEM, AND METHOD FOR DIVERTING WATER AWAY FROM A FOUNDATION." The identified earlier-filed provisional patent application is hereby incorporated by reference in its entirety into the present application.

BACKGROUND

1. Field

Embodiments of the present invention provide an improved splash block for positioning adjacent a building's foundation and for diverting water exiting a sump pump discharge line or a gutter spout away from the building's foundation. More particularly, embodiments of the present invention provide an apparatus and a system comprising a plurality of the improved splash blocks and a method for positioning the improved splash blocks generally end-to-end for diverting the water a longer distance from the foundation than prior art splash blocks and for slowing the water's velocity as it exits each splash block.

2. Related Art

Splash blocks for locating external to a building's foundation and generally proximate a gutter spout or sump pump discharge line are known. The splash block usually has a generally flat bottom and three vertically extending sides. A rear end of the splash block closest to the gutter spout or discharge line is smaller in width than a front end of the splash block, such that the splash block has a general V-shape. Water exiting the gutter spout or discharge line is guided to the splash block and flows down the flat bottom of the splash block and to the earth surrounding the splash block. The water is contained within the flat bottom of the splash block due to the raised sides of the splash block. The purpose of the splash block is to move the water exiting the gutter spout or discharge line away from the building's foundation.

However, current splash blocks do not transport the water far enough from the building's foundation, nor do they allow for positioning relative to obstacles in the yard or area surrounding the building's foundation. Additionally, water exiting prior art splash blocks is often moving at a relatively high velocity, which results in a furrow or pool of water being formed proximate a discharge end of the splash block. Accordingly, there is a need for an improved splash block and splash block system.

SUMMARY

Embodiments of the present invention solve the above-mentioned problems and provide a distinct advance in the art of splash blocks. More particularly, embodiments of the present invention provide an improved splash block that slows the velocity of water exiting a discharge end of the splash block. Additionally, embodiments of the present invention provide a water diverting system comprising a plurality of splash blocks configured to be arranged end-to-end to transport the water a desired distance from the building's foundation. The splash blocks of the system of embodiments of the present invention can also be pivoted with respect to each other so that the splash blocks can be arranged to avoid any structures, plant material, or other impediments in the yard or ground surrounding the building's foundation. Additionally, the splash blocks can be arranged to accommodate a inclination or declination in the terrain surrounding the building's foundation.

A system for diverting water away from a building's foundation broadly comprises a starting splash block for positioning proximate the building's foundation; at least one running splash block for positioning end-to-end with the starting splash block; and a coupling assembly for coupling the front end of the starting splash block to the rear end of the at least one running splash block in the end-to-end configuration.

The starting splash block has a bottom, a rear end for positioning under a water discharge line, a front end opposite the rear end, and left and right side walls extending along a portion of the longitudinal length of the starting splash block. Similarly, the running splash block has a bottom, a rear end, a front end opposite the rear end, and left and right side walls extending along a portion of the longitudinal length of the running splash block. Notably, the rear end of the running splash block does not have a vertically extending rear end wall extending across substantially an entire width of the rear end, such that the front end of the starting splash block can be positioned atop at least a portion of the rear end of the running splash block.

In even further embodiments of the present invention, the starting and running splash blocks have a plurality of vertically upwardly extending projections on the respective bottoms of the splash blocks. The projections serve to slow the velocity of the water transported through and by the splash blocks.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

DESCRIPTION OF THE DRAWING FIGURES

Embodiments of the present invention are described in detail below with reference to the attached drawing figures, wherein.

Figure 1:
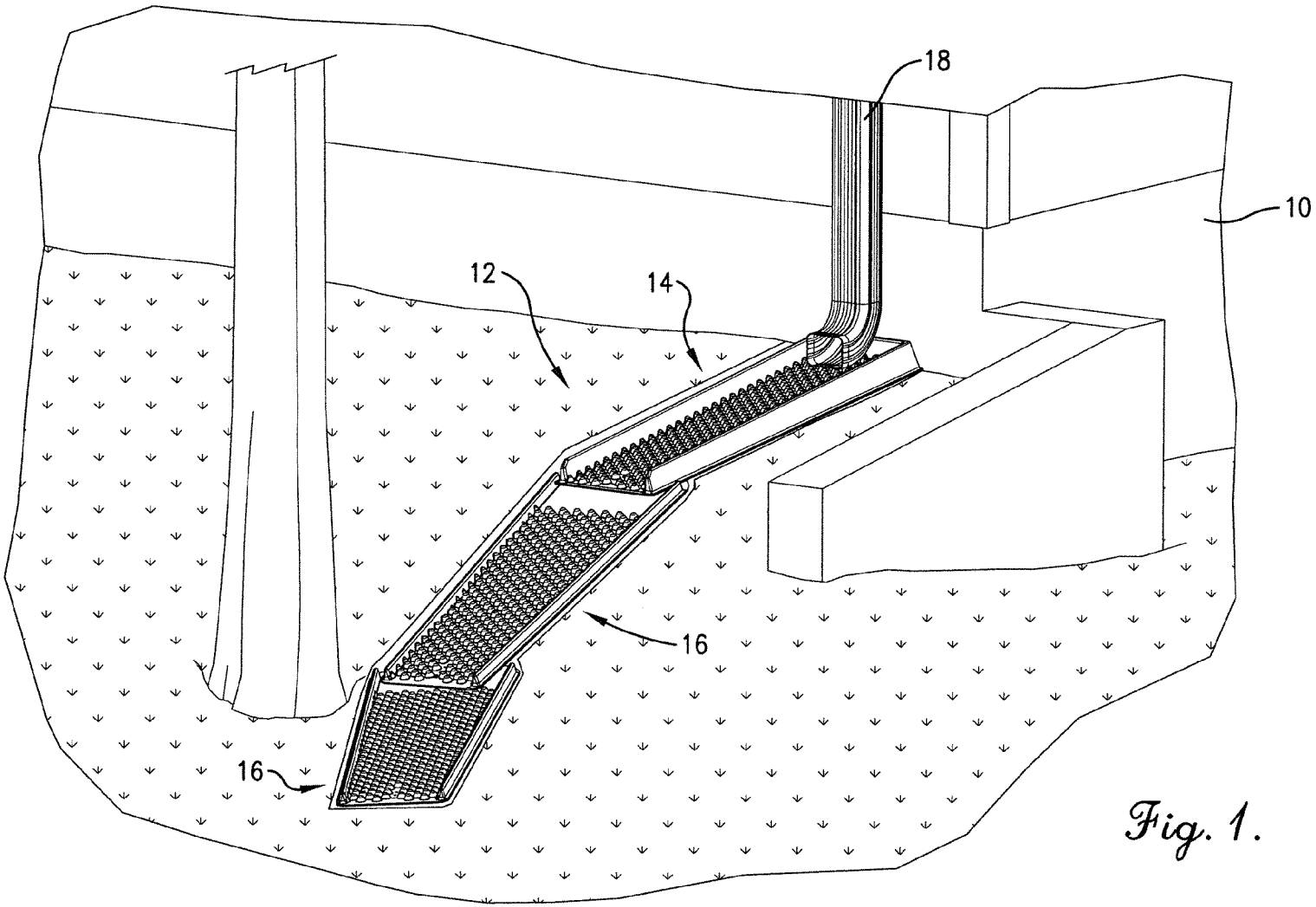
FIG. 1 is an environmental view of a system for diverting water away from a building's foundation.

The drawing figures do not limit the present invention to the specific embodiments disclosed and described herein. The drawings are not necessarily to scale, emphasis instead being placed upon clearly illustrating the principles of the invention.

DETAILED DESCRIPTION

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

Referring to FIG. 1, an apparatus, system, and method for diverting water away from a building's foundation 10 is illustrated. Embodiments of the present invention provide a system 12 comprising a plurality of splash blocks and, in more detail, the system comprises a first, starting splash block 14 and at least one second, running splash block 16. The starting splash block 14 is for positioning proximate a gutter spout 18 or sump pump discharge line (not shown). As is known in the art, a gutter spout 18 transports water from the building's gutter(s) and to the ground or earth surrounding the building's foundation 10, as best illustrated in FIG. 1. Similarly, a sump pump discharge line is commonly positioned on an external wall of the building and transports water from the building's sump pump and to the ground surrounding the building's foundation 10.

In operation and as discussed in more detail below, at least one running splash block 16 is employed with the system 12, although a plurality of running splash blocks 16 may be employed to transport the water a desired distance from the building's foundation 10. The system 12 illustrated in FIG. 1 employs two running splash blocks 16. As further discussed in detail below, the running splash blocks 16 are substantially the same configuration for ease of manufacturing, although small variations in the structure of the running splash blocks 16 are encompassed within embodiments of the present invention.

The first, starting splash block 14 and the second, running splash block(s) 16 have different configurations, although certain features of each of the two types of splash blocks are the same. For ease of reference herein, like features will be indicated with the same reference numeral.

Referring now to FIGS. 2-5, the first, starting splash block 14 (or "starting block") is illustrated. As noted above, the starting block 14 is positioned proximate to, and in some instances adjacent to, the building's foundation 10, such that a portion of the starting block 14 is positioned directly under the gutter spout 18 or sump pump discharge line so that transported fluid from the gutter spout 18 or discharge line falls directly onto the starting block 14 (and as opposed to falling on one of the running splash blocks 16 or on the ground).

The starting block 14 has a rear end 20, a front end 22, and opposed longitudinally extending left and right sides 24,26. An upwardly vertically extending rear end wall 28 extends from the rear end 20 of the starting block 14 and along the block's width. The sides of the rear end wall 28 are joined at a generally 90 degree angle with left and right upwardly vertically extending side walls 30,32 running along the respective left and right sides 24,26 of the block 14, such that the left and right side walls 30,32 extend along substantially the entire longitudinal length of the starting block 14. The front end 22 of the starting block 14 is not provided with a vertically extending wall so that it can be connected with the running splash block 16, as discussed below.

For orientation purposes, the rear end 20 of the starting block 14 is positioned proximate to the building's foundation 10, whereas the front end 22 of the starting block 14 is positioned away from the building's foundation 10, as best illustrated in FIG. 1. Reference to a "rear end" herein for both the starting and running splash blocks 14,16 is considered to be reference to the end of the block closest to the building's foundation 10, and reference to a "front end" herein is considered to be reference to the end of the block farthest away from the building's foundation 10.

Figure 2:
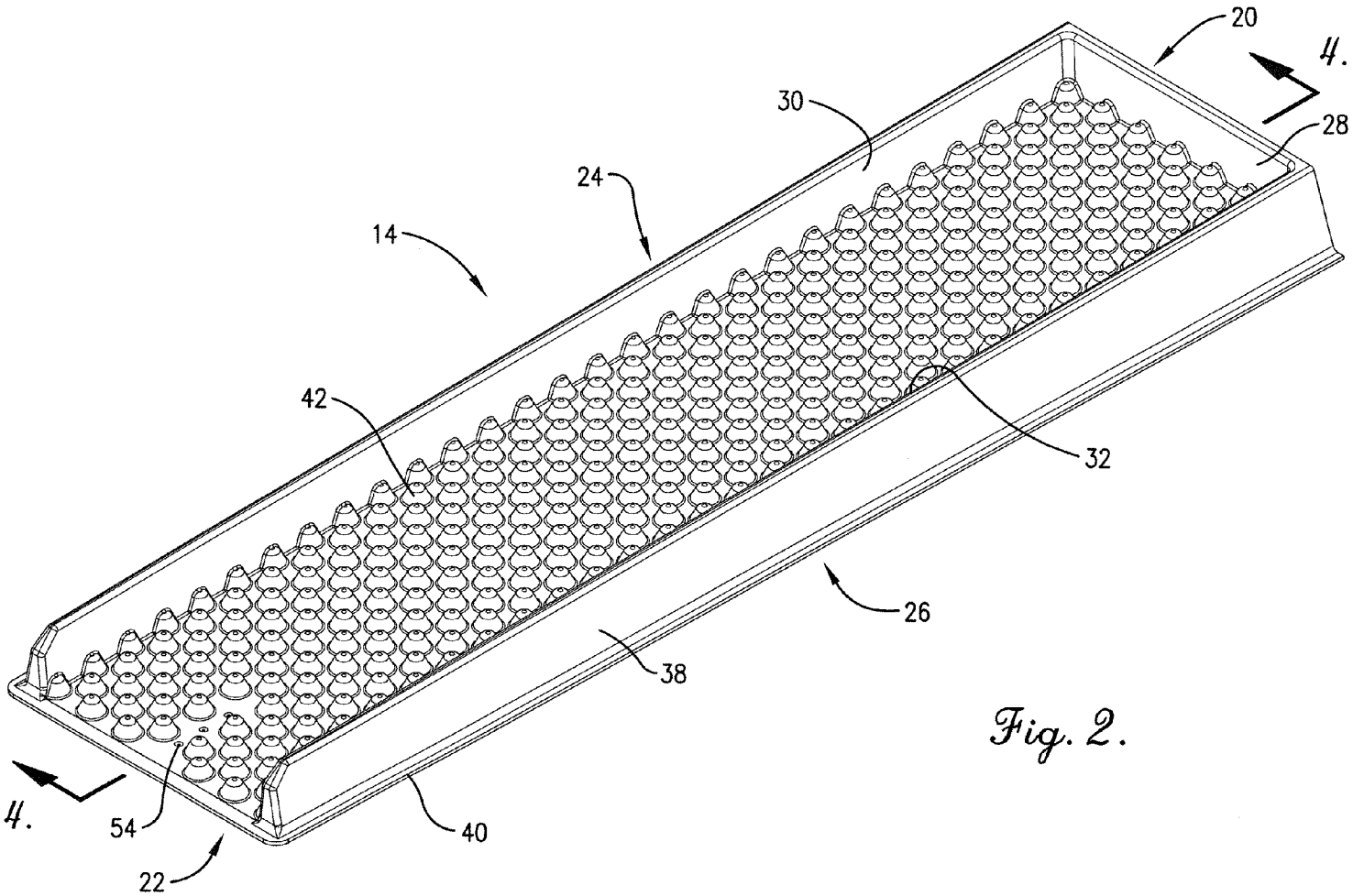
FIG. 2 is a top isometric view of a starting splash block of the system of FIG. 1.
Figure 3:
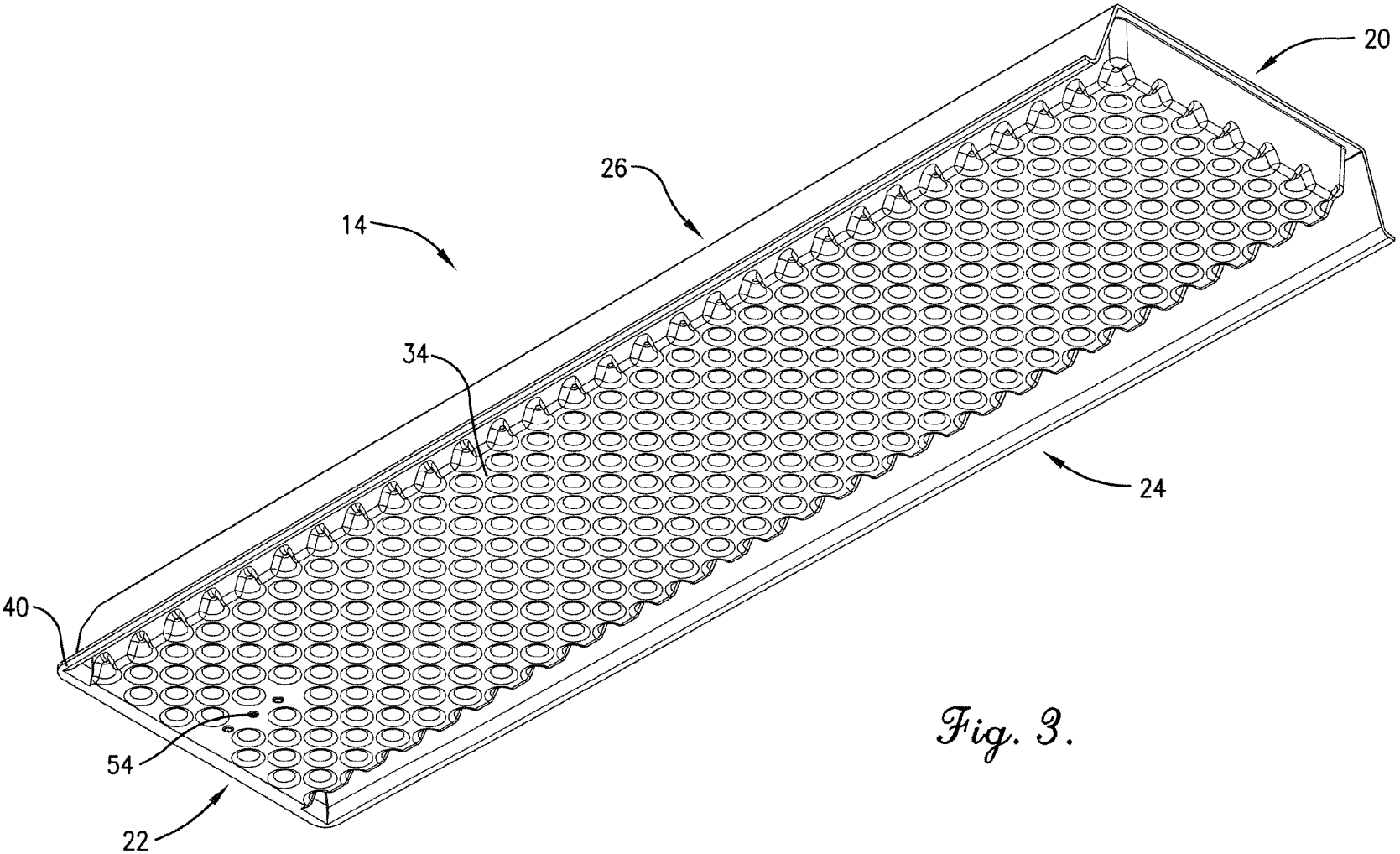
FIG. 3 is a bottom isometric view of the starting splash block of FIG. 2.
Figure 5:
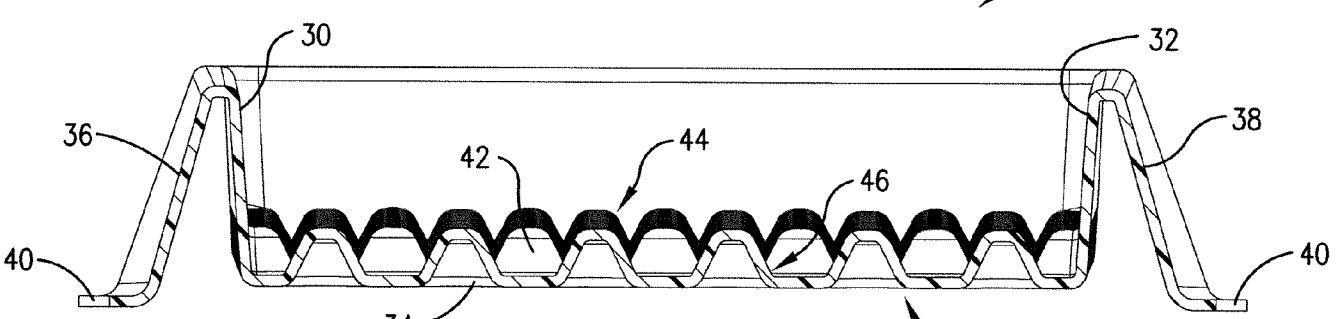
FIG. 5 is a vertical cross-sectional view taken along line 5-5 of FIG. 4.

The rear end wall 28 and left and right side walls 30,32 surround a bottom or floor 34 of the starting block 14, as best illustrated in FIGS. 2-3. Referring to FIG. 5, the left and right side walls 30,32 are integral with left and right exterior side walls 36,38, such that the side walls 30,32 serve as an interior side wall immediately adjacent the bottom 34 of the starting block 14, and the left and right exterior side walls 36,38 face outwardly. The interior side walls 30,32 and the exterior side walls 36,38 together former a general V-shape in vertical cross-section, as illustrated in FIG. 5. The exterior side walls 36,38 are provided with a flange 40 that assists in placement and stability of the block 14 on the ground.

Referring to the upwardly facing orientation in FIG. 2, the bottom 34 of the starting block 14 is provided with a plurality of upwardly vertically extending projections 42 arranged in a uniform pattern or matrix. The projections 42 are spaced relatively close together but do not touch so as to allow water to flow around each projection.

In more detail, the projections 42 are arranged side-by-side, and each projection is of substantially the same size and shape as the surrounding projections 42, except for the projections 42 positioned along, close to, or adjacent the rear end wall 28 and left and right side walls 30,32. The projections 42 illustrated in the drawing figures have a generally conical shape, such that a top end 44 of each projection is smaller in width or diameter than a bottom end 46 of the projection.

Figure 4:
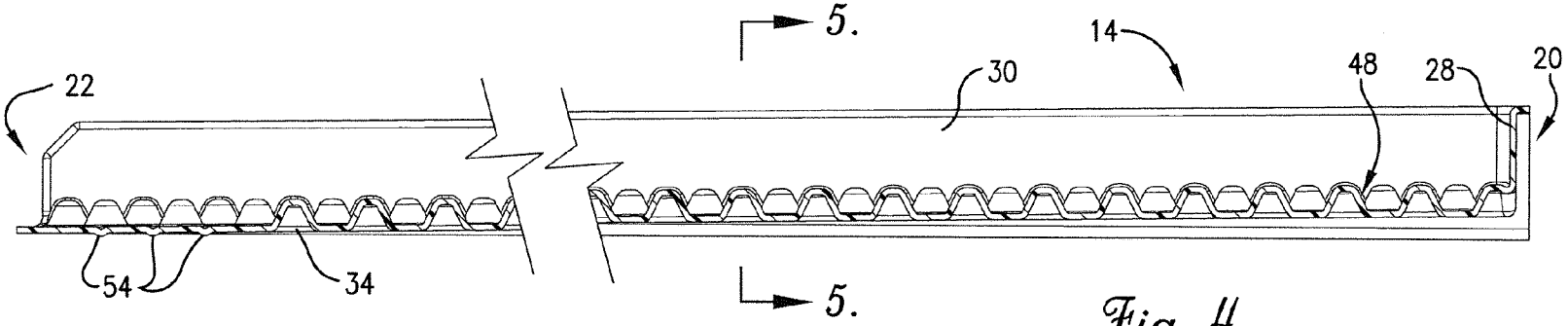
FIG. 4 is a fragmentary vertical cross-sectional view taken along line 4-4 of FIG. 2.

However, it should be appreciated that differently-shaped projections 42 could be used, as discussed below. Applicants have found that a projection 42 having a generally circular bottom end 46 allows water to flow around the projection easily and without collecting at a rear end 48 of the projection closest to the rear end 20 of the block 14, as illustrated in FIG. 4. Moreover, water flowing around the circular bottom end 46 of each projection impacts the next, forward projection at a vector angle that assists in slowing the velocity of the water down the bottom 34 of the splash block 14. In embodiments of the present invention, when water contacts each projection 42, the water flows around the projection at an approximate 45 degree angle relative to a horizontal or transverse axis across the width of the block 14 and between the left and right side walls 30,32. This interference slows the velocity of the water and disperses the energy of the water as it exits the front end 22 of the starting block 14. This results in preventing water exiting the system 12 of splash blocks 14,16 from forming a furrow in the ground or otherwise flooding the surrounding ground. Thus, the projections 42 preferably do not include a generally flat (along its width) and generally horizontally oriented rear end that allows water to collect against the projection 42 at the rear end 48 of the projection.

The shape of the bottom end 46 of the projection 42 can be referred to as the "footprint" of the projection relative to the bottom 34 of the starting block 14. In embodiments of the present invention, the footprint may be circular, as illustrated, or may be elliptical, oval, triangular with a tip of the triangle oriented towards the rear end 20 of the starting block 14, or other suitable footprint shape that allows the water to flow easily around the projection. More specifically, the projections 42 may have a curvilinear or arcuate rear end 48 facing towards the rear end 20 of the starting block 14. In the case of the triangle shaped projection with the tip of the triangle oriented towards the rear end 20 of the block 14, the rear end 48 of the projection 42 may comprise a general point or sharply angled face that does not present a substantially flat edge or wall.

Each projection 42 on the starting splash block 14 is approximately 0.125-1 inch high, approximately 0.33-0.75 inch high, approximately 0.25-0.5 inch high, or approximately 0.4 inch high. A height of each projection 42 is at least approximately ⅕, at least approximately ¼, at least approximately ⅓, at least approximately ½, at least approximately ⅔, at least approximately ¾, or substantially the same height as a height of either or both of the left and right side walls 30,32 of the starting block 14. Each projection 42 is approximately 0.25-2 inches wide (at its widest point), approximately 0.5-1.5 inches wide (at its widest point), approximately 0.75-1 inch wide (at its widest point), or approximately 0.75 inch wide (at its widest point). In the instance where the projection's bottom end 46 is generally circular, the width of the projection corresponds to a diameter of the projection. The largest distance between side-by-side projections 42 (as measured from the exterior of the footprints of the side-by-side projections) is less than or equal to approximately 2 inches, less than or equal to approximately 1 inch, or approximately 0.75 inch.

As noted above, the bottom 34 of the starting block 14 is provided with the matrix of projections 42. Thus, it is intended that a large number of projections 42 be provided on the bottom 34 of the block 14, as opposed to only a few projections 42 (e.g., less than ten to twenty projections 42). To describe the large number of projections 42 provided on the bottom 34 of the block 14, a ratio of a density of the number of projections 42 for a particular area to the same-sized area of the bottom 34 of the starting block 14 is herein described. In particular, for at least one area of the bottom 34 of the starting block 14 having a size approximately 25 inches square, there are greater than or equal to approximately 10 projections 42, greater than or equal to approximately 15 projections 42, or greater than or equal to approximately 20 projections 42. In embodiments of the present invention, the splash blocks 14,16 have at least approximately 50 projections 42, at least approximately 100 projections 42, or at least approximately 150 projections 42.

In even further alternative embodiments of the present invention, the projections 42 may have differing heights and/or widths within the matrix of projections 42 located on the particular splash block 14,16. In yet further alternative embodiments of the present invention, the projections 42 may have a shape different than the conical shape illustrated in the drawings, or the projections 42 may have differing shapes within the matrix of projections 42 located on the particular splash block 14,16, such that some of the projections 42 have a conical shape presenting a circular bottom end 46 or footprint while other projections 42 have an elliptical or oval footprint.

Referring to FIG. 3, an underside 50 of the starting block 14 is illustrated. In embodiments of the present invention, the underside 50 of the block 14 is generally open and hollow. This is primarily due to the method of manufacturing and the materials used for manufacture. In embodiments, the starting and running blocks 14,16 are formed of ABS, aluminum, steel, or other suitable, light-weight material. Alternatively, the blocks 14,16 could be formed of concrete. In preferred embodiments, the blocks 14,16 are extruded plastic, which results in the hollowed underside 50. The plastic may be supplemented with a UV inhibitor.

Figure 10:
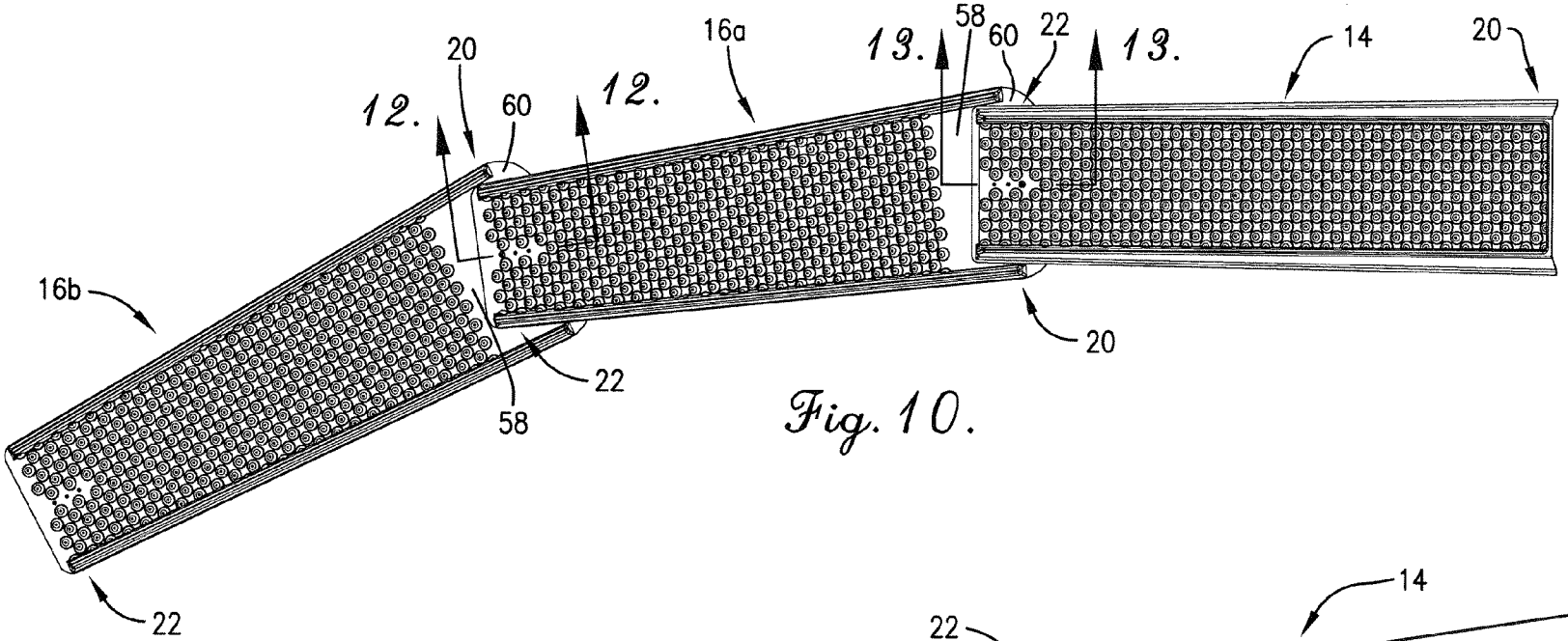
FIG. 10 is a plan view of a starting splash block and two running splash blocks arranged end-to-end and pivoted with respect to each other.

Referring to FIGS. 2-3 and 12-13, the system 12 of embodiments of the present invention includes a coupling assembly 52 for coupling the starting splash block 14 and the running splash block 16 or two running splash blocks 16 (as the case may be) together. The coupling assembly 52 comprises at least one screw receiving area 54 formed in the front end 22 of each of the starting splash block 14 and the running splash block 16 and at least one screw 56 or other fastener, such as a bolt or a plastic or nylon rivet. As discussed below, use of a plurality of screw receiving areas 54 arranged in a row allows for the installer of the system 12 to selectively choose an angle at which the next starting block in line is positioned relative to the immediately preceding starting block, as illustrated in FIGS. 1 and 10.

In preferred embodiments of the present invention, three screw receiving areas 54 are arranged in a row along at least a portion of the longitudinal length of the front end 22 of the respective block 14,16. Each screw receiving area 54 is separated by the next screw receiving area 54 in the row by approximately 0.25-2 inches or approximately 1 inch. In embodiments of the present invention, the frontmost screw receiving area 54 is spaced from the frontmost end of the respective block 14,16 by at least approximately 0.5 inch, 1 inch, or 1.5 inches. More or less screw receiving areas 54 could be used with the system 12 of embodiments of the present invention. Additionally, the screw receiving areas 54 could also be formed in the rear end 20 of the running splash block 16, as opposed to the front end 22 of each block 14,16.

Figure 12:
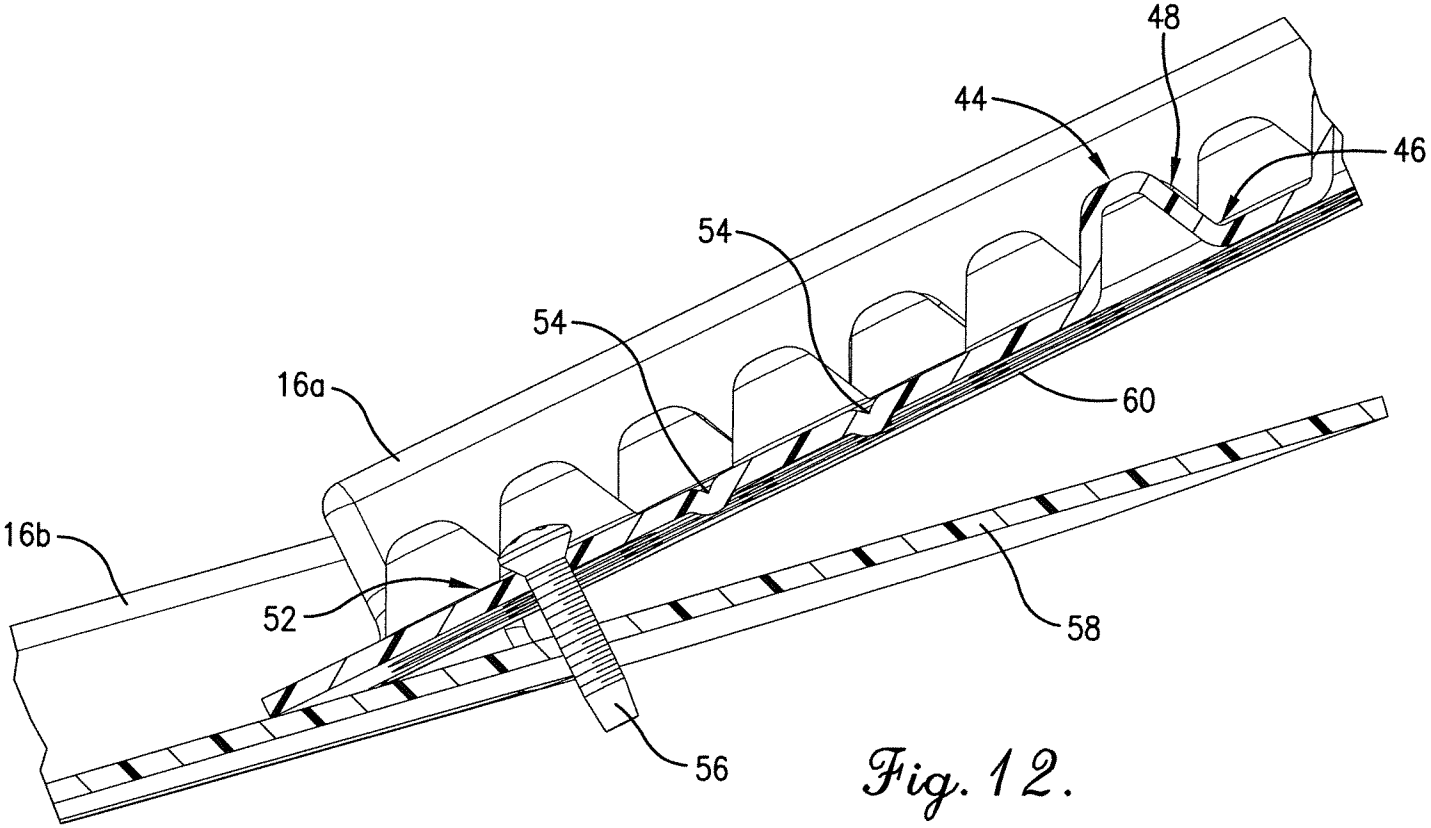
FIG. 12 is a fragmentary vertical cross-sectional view taken along line 12-12 of FIG. 10.
Figure 13:
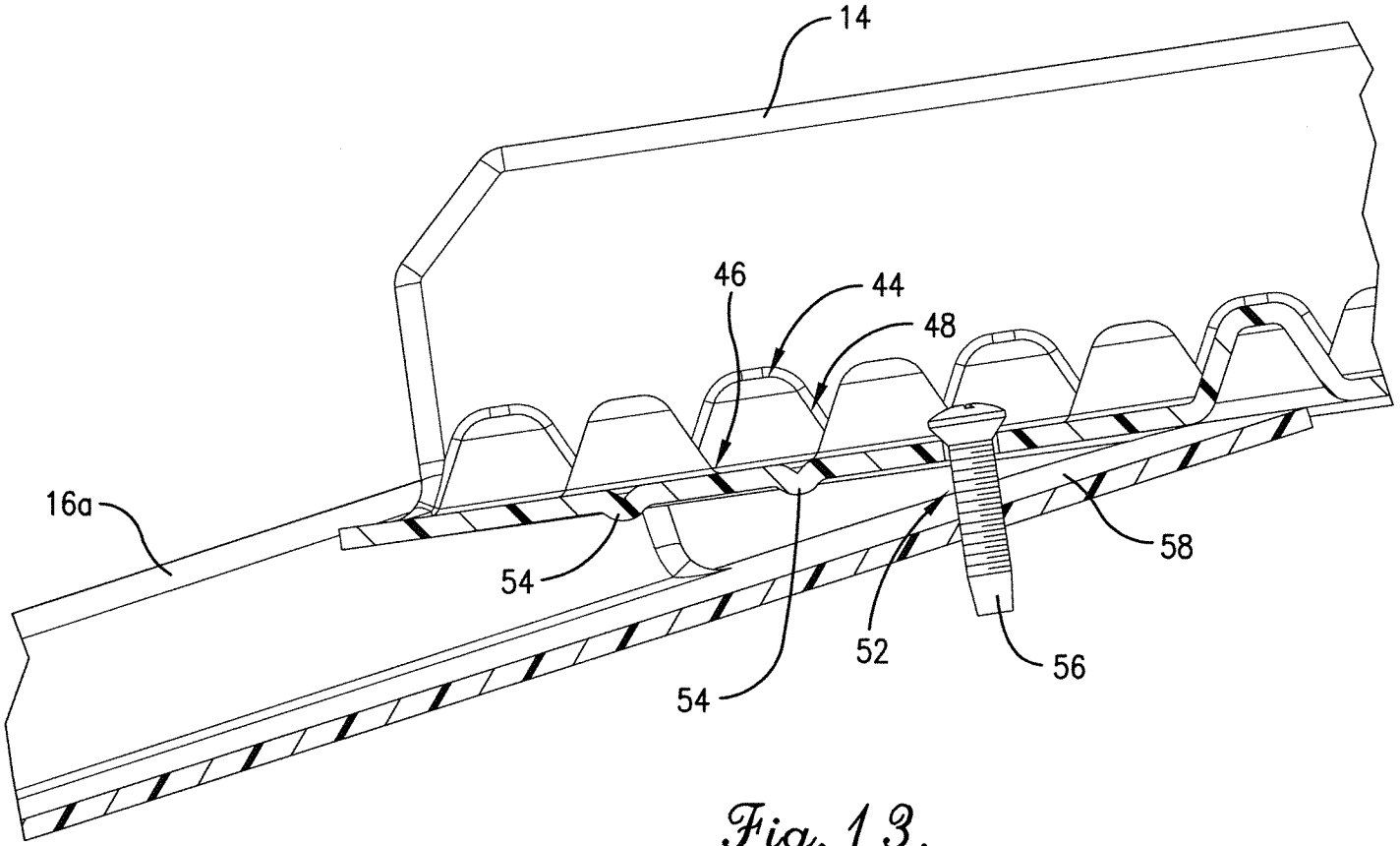
FIG. 13 is a fragmentary vertical cross-sectional view taken along line 13-13 of FIG. 10.

In embodiments of the present invention, the screw receiving area 54 is an indicator of where the screw should be received, and the indicator could be a punch mark or depression formed in the front end 22 of the splash block 14,16. The depression forms a weakened area in the bottom of the respective block 14,16 to allow for ease of inserting the screw 56 through the depression, as illustrated in FIGS. 12-13. As discussed below, an installer of the system 12 can insert a tip of the screw 56 through the depression and easily puncture the weakened depression to form an opening through the bottom 34 of the block 14,16. Alternatively, the screw receiving areas 54 could be openings pre-formed in the bottom 34 of the block 14,16.

Referring now to FIGS. 6-9, the running splash block 16 (or "running block") is illustrated and described. The running block 16 is similar in configuration to the starting splash block 14, except that the rear end 20 of the running block 16 does not include a rear end wall, as does the starting block 14. This is because the rear end 20 of the running block 16 is configured to be coupled with the front end 22 of the immediately preceding block, which may be either the starting block 14 or another running block 16. In contrast, the front end 22 of the running block 16 is substantially similar in configuration to the front end 22 of the starting block 14. Notably, the front end 22 of the running block 16 includes the screw receiving areas 54 formed in a row along at least a portion of the longitudinal length of the front end 22. In alternative embodiments of the present invention, the rear end 20 of the running block 16 may have a punch mark, depression, opening, or other indicator (not shown) to assist the installer in locating where the screw 56 should be installed on the rear end 20 of the block 16.

Figure 6:
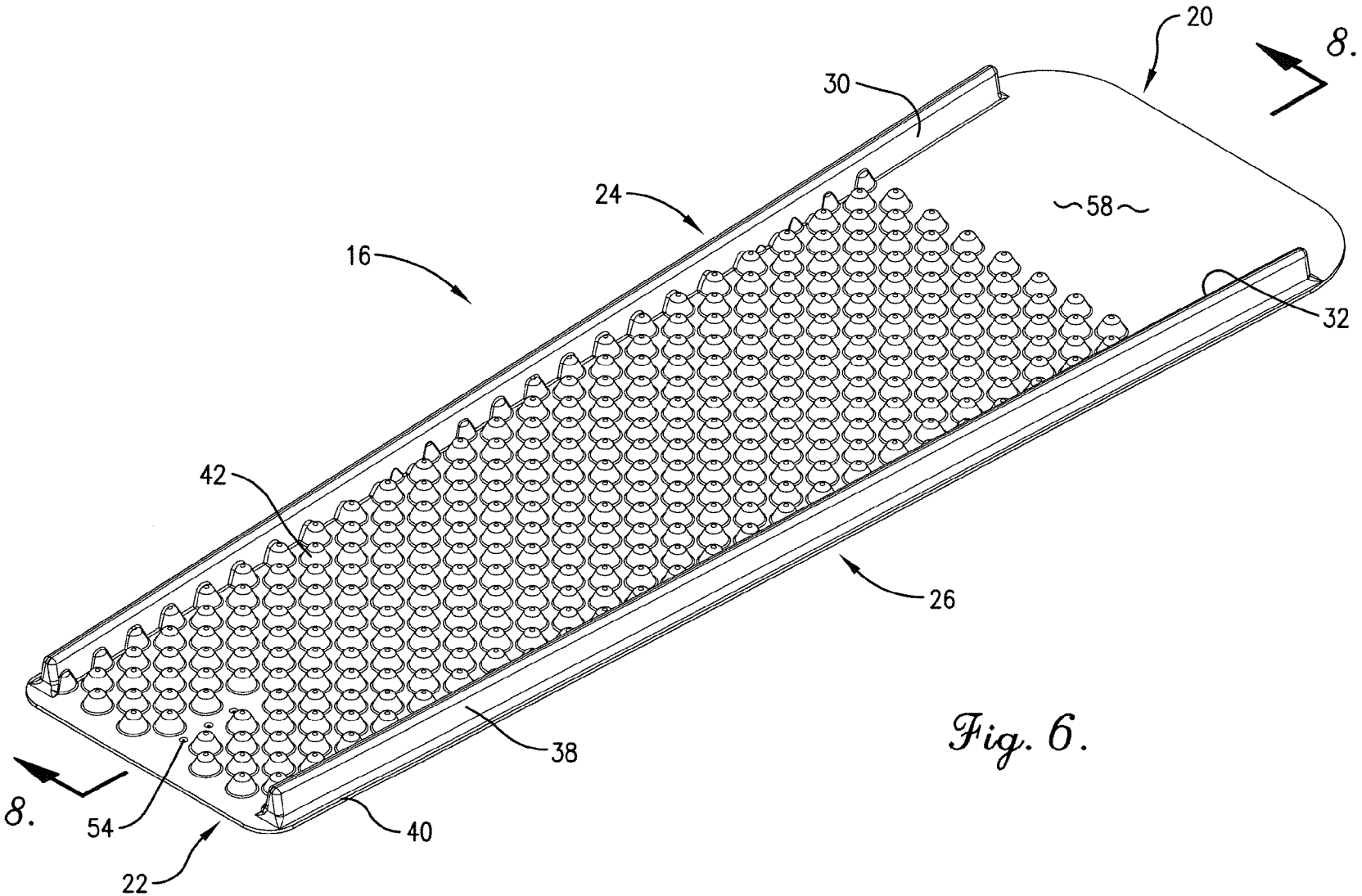
FIG. 6 is a top isometric view of a running splash block of the system of FIG. 1.
Figure 7:
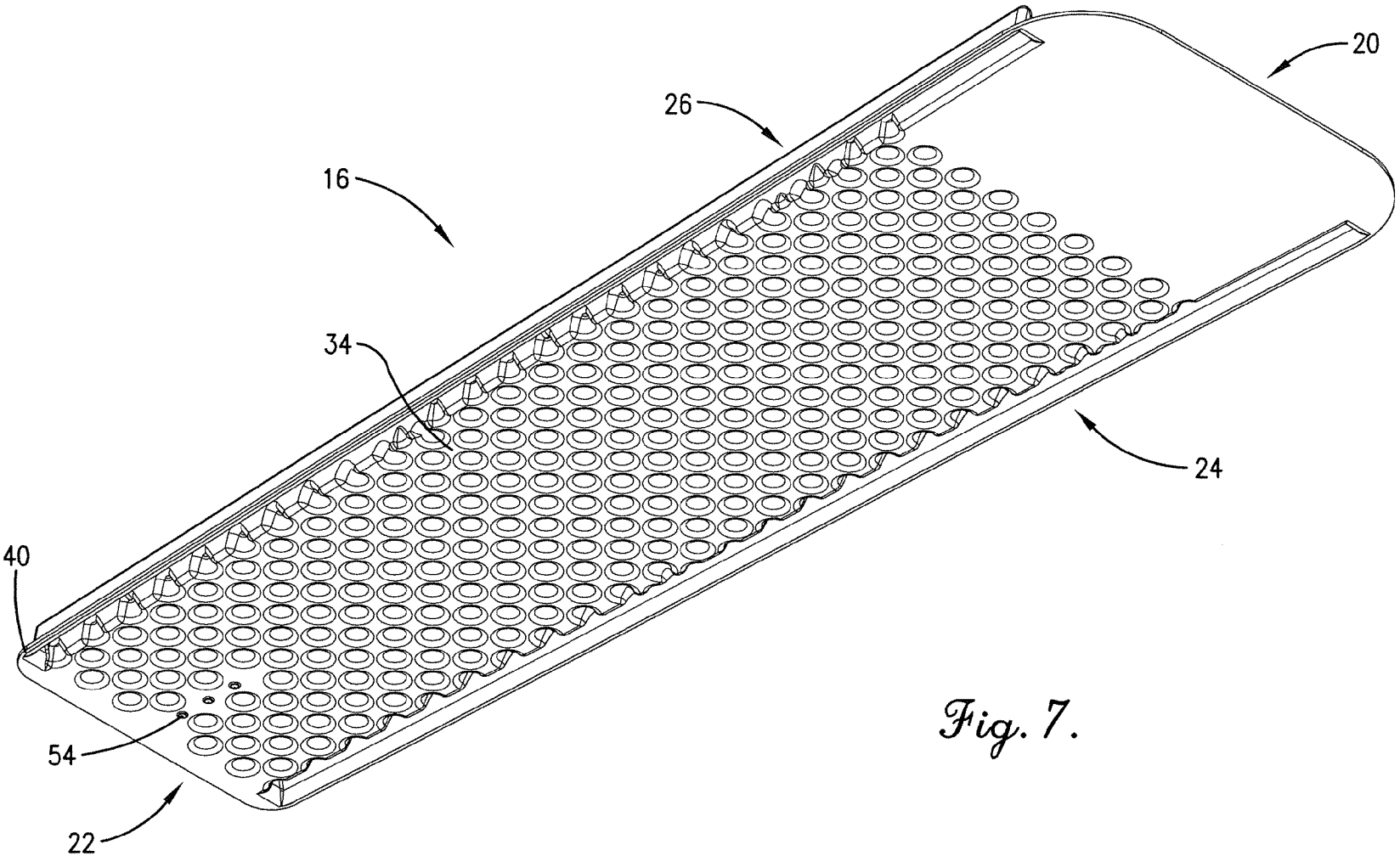
FIG. 7 is a bottom isometric view of the running splash block of FIG. 6.
Figure 8:
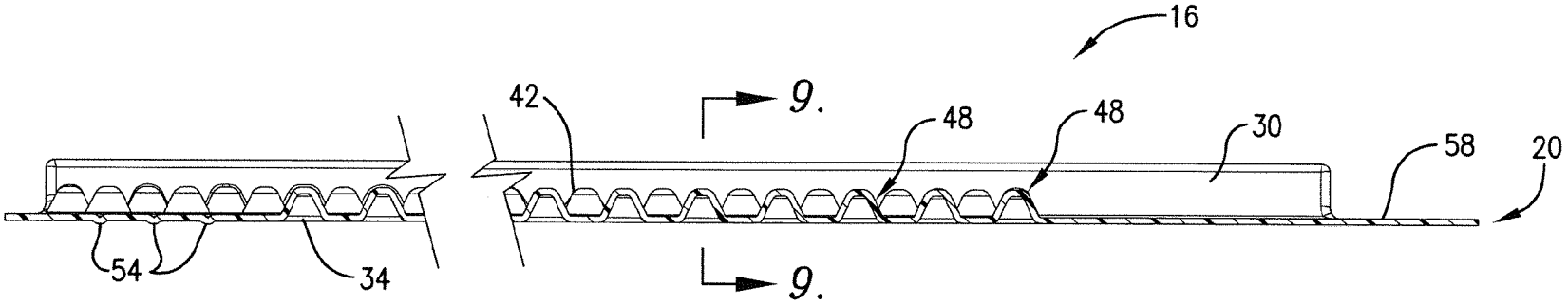
FIG. 8 is a fragmentary vertical cross-sectional view taken along line 8-8 of FIG. 6.
Figure 9:
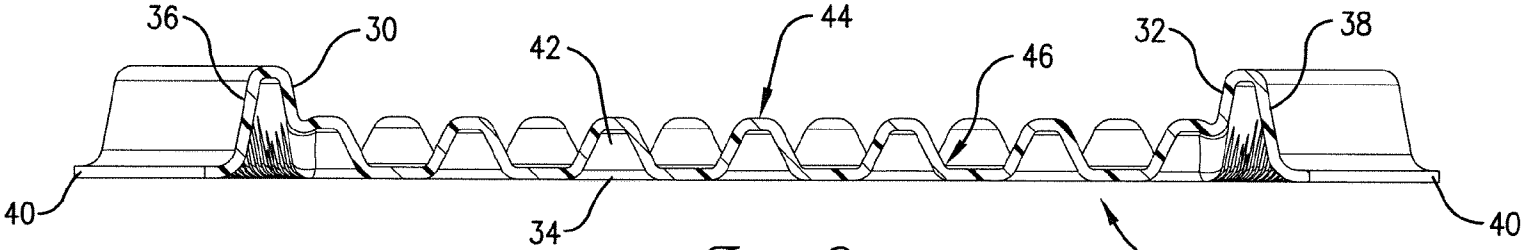
FIG. 9 is a vertical cross-sectional view taken along line 9-9 of FIG. 8.

As illustrated in FIGS. 6-7, projections 42 are not formed on the rear end 20 of the running block 16. In embodiments of the present invention, a portion or length of the rear end not provided with projections, indicated by reference numeral 58, is approximately at least 5%, approximately at least 10%, or approximately at least 15% the total length of the running block 16. Alternatively stated, the length of the portion 58 of the rear end not provided with any projections is at least approximately 2 inches, at least approximately 4 inches, or at least approximately 8 inches. As described in detail below, the purpose of having the portion 58 of the rear end of the running block 16 not provided with any projections 42 is so that the front end 22 of the immediately preceding block positioned atop the rear end 20 of the next running block 16 does not interfere with or contact a projection. This assists in location and angular orientation of the splash blocks relative to each other. As also illustrated in FIGS. 6-7, the left and right side walls 30,32 extend substantially the entire length of the running block 16, and, in particular, extend along substantially the entire length 58 of the rear end not provided with any projection.

In embodiments of the present invention, a length of each of the starting and running splash blocks is approximately 20-70 inches, approximately 30-60 inches, or approximately 40-50 inches. It is to be appreciated that the starting and running blocks 14,16 may have different lengths, or the system 12 may include running splash blocks 16 of varying length. As illustrated in the drawing figures, a width of the starting splash block 14 is greatest at the rear end 20 and smallest at the front end 22, wherein the width has a small taper. The width at the widest point is approximately 10 inches, and the width at the narrowest point is approximately 9.5 inches. Similarly, a width of the running splash block 16 is greatest at the rear end 20 and smallest at the front end 22. The width at the widest point is approximately 13 inches, and the width at the narrowest point is approximately 9.5 inches. Because the front end 22 of each splash block 14,16 is smaller in width than the rear end 20 of the next splash block in line, the front end 22 of the splash block 14,16 fits over the rear end 20 of the next splash block and between the side walls 30,32 of the next splash block.

A method of installing and using the system 12 of embodiments of the present invention will not be described. Referring to FIGS. 1 and 10-13, the system 12 is installed relative to the building's foundation 10 by first locating the starting splash block 14 underneath the gutter spout 18 or the sump pump drainage line. As noted above, the running splash block 16 is then coupled end-to-end with the starting splash block 14. It is to be appreciated that reference to "end-to-end" alignment of the splash blocks is intended to encompass the front end 22 of the first, starting splash block 14 in the line overlaying a portion of the rear end 20 of the next, running splash block 16 in line and so forth. Reference to the "end-to-end" configuration is not intended to describe a frontmost end of the starting splash block 14 being directly adjacent to, but not overlapping, a rearmost end of the next, running splash block 16.

At least one running splash block 16 is used with the system 12 of embodiments of the present invention and more can be used, if desired. As discussed above, the starting block 14 and two running blocks 16 are provided in the system 12 illustrated in FIGS. 1 and 10-13.

Upon positioning of the starting block 14, the installer then lays out the desired number of running blocks 16 end-to-end. In particular, the installer positions the rear end 20 of the running block 16 at the desired pivot angle relative to the immediately preceding block (the starting block 14 or another running block 16, as the case may be) to obtain the curvature of the end-to-end aligned blocks 14,16. For example, in FIG. 1, the running blocks 16 are angled to avoid the tree illustrated in the drawing figure. If the running blocks 16 could not be pivoted with respect to each other, and, in particular, could only be aligned along a straight line, then the running blocks 16 would "run into" or otherwise be impeded by the tree.

Thus, use of multiple blocks, and, in particular, one or more running blocks 16, allows the installer to transport the water around obstacles surrounding the building's foundation 10. Additionally, use of one or more running blocks 16 allows the installer to transport the water a desired distance from the building's foundation 10. As is known, water stagnating proximate a building's foundation 10 can cause many undesired problems, including water leakage into the basement and cracking of the building's foundation 10. However, transporting the water a length of only the starting block does not necessarily avoid this problem, as the water exiting the starting block is still relatively close to the building's foundation 10 and not clearing the backfill. Use of one or more running blocks 16 allows the installer to transport the water a desired distance, and to a desired location, away from the building's foundation 10.

To obtain the curvature of the end-to-end aligned blocks, the installer positions the front end 22 of the starting block 14 on the rear end 20 of the first running block 16, i.e., the running block positioned immediately adjacent the starting block. Referring now to FIG. 10, a portion 60 of the front end of the starting block is located atop the length 58 of the rear end of the running block 16*a* that does not include any projections. Depending on how far forward the portion 60 of the front end of the starting block 14 is placed relative to the length 58 of the rear end of the running block 16 that does not include any projections 42, and further in which screw receiving area 54 the screw 56 is installed, the pivoting angle of the running block 16 relative to the starting block 14 will vary. This is further illustrated by comparing the angle of pivot of running block 16*b* in FIG. 10 to the angle of pivot of running block 16*a*. Thus, if a large pivot angle is desired, the frontmost screw receiving area 54 is used (see, the angle of pivot between blocks 16 and 16*b*), and if only a relatively small pivot angle is desired, the rearmost screw receiving area 54 is used (see, the angle of pivot between blocks 14 and 16*a*).

In embodiments of the present invention and when considering two blocks aligned end-to-end (regardless of whether it is a starting block 14 aligned with a running block 16 or two aligned running blocks 16), the angle of pivot of the forward block relative to the rear block can range from approximately 10 degrees to approximately 70 degrees, from approximately 20 degrees to approximately 60 degrees, or from approximately 30 degrees to approximately 50 degrees.

Once the installer has arranged the starting block 14 and the running blocks 16*a*,16*b* as desired, the installer then permanently couples the blocks together via the coupling assembly 52. Referring now to FIGS. 12-13, the installer secures the screw 56 through the screw receiving area 54 that provides the desired angle of pivot. The screw 56 is installed through the screw receiving area 54, e.g., depression, and then through the length 58 of the rear end 20 of the underlying running block 16*a*,16*b*. If desired, the installer can drill a hole or opening through the depression and through the underlying running block 16*a*,16*b* for ease of installation of the screw 56. The screw can be secured with a washer and bolt combination (not shown), if desired.

Figure 11:
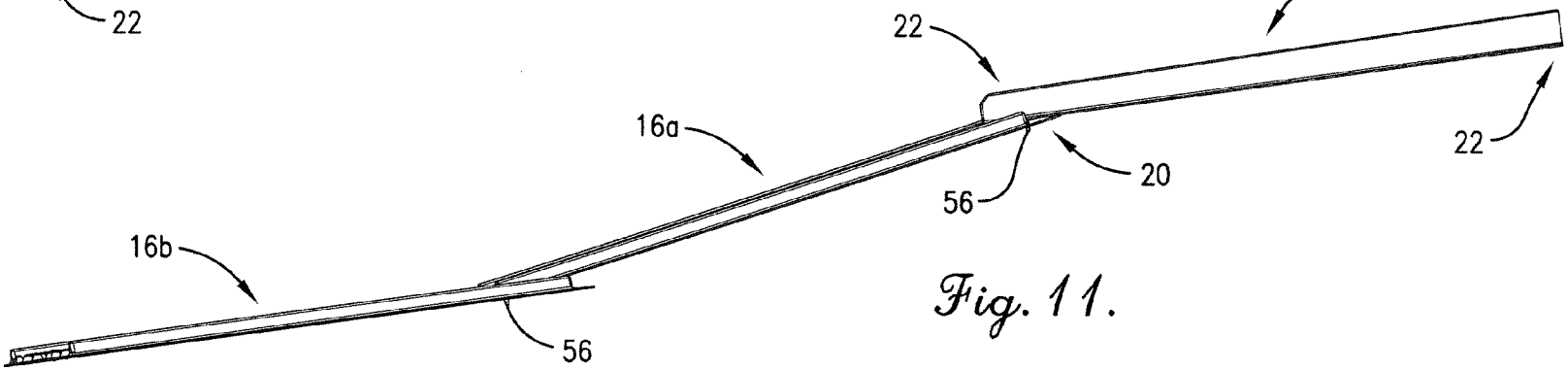
FIG. 11 is a right side end view of the system of splash blocks of FIG. 10.

It is noted that the drawings, and especially FIGS. 11-13, illustrate the blocks 14,16 arranged along a vertical decline when viewed from the starting block 14 and to the forwardmost running block 16*b*. It is to be appreciated that the blocks may be arranged along the elevation of the ground surrounding the building's foundation (regardless of whether the ground is flat or has an incline/decline), and that the vertical decline shown in the drawings is for ease of illustration and comparison and is not a necessary feature of the invention.

Although the system 12 of embodiments of the present invention has been described wherein each of the running blocks 16 has the same configuration, it is to be appreciated that the system 12 may include a forwardmost running block that does not include the screw receiving areas. However, for ease of manufacture so that only one configuration of a running block is required, each running block includes the screw receiving areas 54.

Although the invention has been described with reference to the embodiments illustrated in the attached drawing figures, it is noted that equivalents may be employed and substitutions made herein without departing from the scope of the invention as recited in the claims. For example, instead of the front end 22 of each splash block being positioned atop the rear end 20 of the following or next splash block in line, the rear end of the next splash block could be positioned atop the front end of the preceding splash block. If such an arrangement is made, then a portion of the front end of each splash block would not be provided with any projections 42 thereon. Additionally, the rear end of each splash block would be the same as or smaller than the front end of each splash block.

Having thus described various embodiments of the invention, what is claimed as new and desired to be protected by Letters Patent includes the following:

1. A system for diverting water away from a building's foundation comprising:

a starting splash block for positioning proximate the building's foundation, the starting splash block including— a bottom, a rear end for positioning under a water discharge line, a front end longitudinally opposite the rear end, left and right side walls extending along a portion of the longitudinal length of the starting splash block, a plurality of indicators for receipt of a screw, wherein the indicators are aligned in a longitudinal row along a portion of the bottom at the front end of the starting splash block, and a plurality of projections formed on the bottom of the starting splash block and vertically extending therefrom, wherein each projection has a rear end facing towards the rear end of the starting splash block, and said rear end does not have a flat side against which water can collect; and at least one running splash block for positioning end-to-end with the starting splash block, the running splash block including— bottom, a rear end, a front end longitudinally opposite the rear end, left and right side walls extending along a portion of the longitudinal length of the running splash block, a plurality of indicators for receipt of a screw, wherein the indicators are aligned in a longitudinal row along a portion of the bottom at the front end of the running splash block, and a plurality of projections formed on the bottom of the running splash block and vertically extending therefrom, wherein each projection has a rear end facing towards the rear end of the running splash block, and said rear end does not have a flat side against which water can collect, wherein the rear end of the running splash block does not have a vertically extending rear end wall extending across substantially an entire width of the rear end and further wherein a length of the bottom at the rear end of the running splash block is not provided with any projections, such that the front end of the starting splash block can be positioned atop at least a portion of the rear end of the running splash block.

2. The system of claim 1, wherein the at least one running splash block is a first running splash block and further including a second running splash block, wherein the second running splash block has a bottom, a rear end, a front end longitudinally opposite the rear end, and left and right side walls extending along a portion of the longitudinal length of the second running splash block, wherein the second running splash block does not have a vertically extending rear end wall extending across substantially an entire width of the rear end of the second running splash block, such that the front end of the first running splash block can be positioned atop at least a portion of the rear end of the second running splash block.

3. The system of claim 1, wherein the rear end of the at least one running splash block is pivotable with respect to the front end of the starting splash block to provide an angle of pivot between the starting and running splash blocks.

4. The system of claim 3, wherein the plurality of indicators for each of the starting and running splash blocks comprises at least a first and a second indicator arranged in the longitudinal row, and a selection of either of the first or second indicators provides for varying angle of pivots between the starting and running splash blocks.

5. The system of claim 1, wherein each projection extending from the starting and running splash blocks has a generally curvilinear footprint.

6. The system of claim 5, wherein each of the starting and running splash blocks has at least approximately fifty projections formed on the respective bottoms.

7. The system of claim 1, wherein the length of the bottom at the rear end of the running splash block that is not provided with any projections is at least three inches in length.

8. A system for diverting water away from a building's foundation comprising:

a starting splash block for positioning proximate the building's foundation, the starting splash block including— a bottom, a rear end for positioning under a water discharge line, a front end longitudinally opposite the rear end, left and right side walls extending along a portion of the longitudinal length of the starting splash block, at least one indicator for receipt of at least one fastener, wherein said at least one indicator is located along a portion of the bottom at the front end of the starting splash block, and a plurality of projections formed on the bottom of the starting splash block and vertically extending therefrom; and at least one running splash block for positioning end-to-end with the starting splash block, the running splash block including— a bottom, a rear end, a front end longitudinally opposite the rear end, left and right side walls extending along a portion of the longitudinal length of the running splash block, at least one indicator for receipt of at least one fastener, wherein said at least one indicator is located along a portion of the bottom at the front end of the running splash block, and a plurality of projections formed on the bottom of the running splash block and vertically extending therefrom, wherein the rear end of the running splash block does not have a vertically extending rear end wall extending across substantially an entire width of the rear end and further wherein a length of the bottom at the rear end of the running splash block is not provided with any projections, such that the front end of the starting splash block can be positioned atop at least a portion of the rear end of the running splash block, wherein the rear end of the at least one running splash block is pivotable with respect to the front end of the starting splash block to provide an angle of pivot between the starting and running splash blocks, wherein said at least one indicator for each of the starting and running splash blocks comprises at least a first and a second indicator arranged in a longitudinal row, and a selection of either of the first or second indicators provides for varying angle of pivots between the starting and running splash blocks.

9. The system of claim 8, wherein the at least one running splash block is a first running splash block and further including a second running splash block, wherein the second running splash block has a bottom, a rear end, a front end longitudinally opposite the rear end, and left and right side walls extending along a portion of the longitudinal length of the second running splash block, wherein the second running splash block does not have a vertically extending rear end wall extending across substantially an entire width of the rear end of the second running splash block, such that the front end of the first running splash block can be positioned atop at least a portion of the rear end of the second running splash block.

10. The system of claim 8, wherein each projection extending from the starting and running splash blocks has a generally curvilinear footprint.

11. The system of claim 10, wherein each of the starting and running splash blocks has at least approximately fifty projections formed on the respective bottoms.

12. The system of claim 8, wherein the length of the bottom at the rear end of the running splash block that is not provided with any projections is at least three inches in length.

* * * * *